US006843081B1

(12) United States Patent
Painter

(10) Patent No.: US 6,843,081 B1
(45) Date of Patent: Jan. 18, 2005

(54) SECURE FIREARM HOLDER

(76) Inventor: Terry M. Painter, 199 Guinea Rd., Moyock, NC (US) 27958

( * ) Notice: Subject to any disclaimer, the term of this patent is extended or adjusted under 35 U.S.C. 154(b) by 0 days.

(21) Appl. No.: 10/653,165

(22) Filed: Sep. 3, 2003

Related U.S. Application Data

(60) Provisional application No. 60/442,914, filed on Jan. 28, 2003.

(51) Int. Cl.[7] ..... B65D 55/14

(52) U.S. Cl. ..... 70/63; 206/317; 42/70.11; 109/45

(58) Field of Search ..... 70/63; 109/45, 109/47, 48, 53, 54, 58; 224/244; 206/317; 42/70.01, 70.06, 70.07, 70.11, 70.09, 1.01

(56) References Cited

U.S. PATENT DOCUMENTS

| | | | | | |
|---|---|---|---|---|---|
| 1,557,339 | A | * | 10/1925 | Sander | 224/542 |
| 3,031,069 | A | * | 4/1962 | Hirsch | 206/317 |
| 3,307,755 | A | * | 3/1967 | Lentz | 206/317 |
| 3,464,606 | A | * | 9/1969 | Nordeen | 224/281 |
| 3,731,818 | A | * | 5/1973 | Young | 206/317 |
| 4,309,065 | A | * | 1/1982 | Pappas | 312/242 |
| 5,048,682 | A | * | 9/1991 | Taylor | 206/317 |
| 5,056,342 | A | | 10/1991 | Prinz | |
| 5,111,755 | A | * | 5/1992 | Rouse | 109/25 |
| 5,118,175 | A | | 6/1992 | Costello | |
| 5,168,994 | A | * | 12/1992 | Beletsky et al. | 206/317 |
| 5,172,575 | A | * | 12/1992 | Fisher | 70/63 |
| 5,236,086 | A | | 8/1993 | MacTaggart | |
| 5,683,021 | A | | 11/1997 | Setina | |
| 5,881,584 | A | | 3/1999 | Brunoski et al. | |
| 5,901,589 | A | | 5/1999 | Cordero | |
| 5,916,087 | A | * | 6/1999 | Owens | 5/503.1 |
| 5,987,941 | A | | 11/1999 | Zocco | |
| D426,059 | S | | 6/2000 | Siler et al. | |
| 6,405,861 | B1 | | 6/2002 | Siler et al. | |
| 6,570,501 | B2 | * | 5/2003 | Bushnell et al. | 340/542 |

* cited by examiner

*Primary Examiner*—Suzanne Dino Barrett
(74) *Attorney, Agent, or Firm*—Birch, Stewart, Kolasch & Birch, LLP

(57) ABSTRACT

A secure firearm holder (10) includes an outwardly swinging hinged plate (14) that is hinged to a holder base (12) with a gun (44) mounted at a side of the plate in a ready-to-use orientation when the plate swings outwardly. In a preferred embodiment, a bore shaft (36) is mounted on the hinged plate, the bore shaft extending into the firearm. When the plate is in a first, closed, position, the holder base prevents the gun from being removed from the bore shaft, but when a motivating member (52) rotates the plate to a second position, the gun can be easily and quickly removed from the bore shaft from a ready-to-use orientation. The motivating member biases the lid toward the second position but is held closed in the first position by a latch (50), which latch is remotely releasable. A locking mechanism has three positions: a totally-locked position (B) for locking the latch (50) against remote release of the lid; an active position (A) for allowing remote release of the lid; and a manual-release position (C) for releasing the lid manually.

25 Claims, 2 Drawing Sheets

SECURE FIREARM HOLDER

This non-provisional application claims priority under 35 U.S.C. 119(e) on Provisional Application Ser. No. 60/442,914, which was filed on Jan. 28, 2003 and is herein incorporated by reference.

BACKGROUND OF THE INVENTION

This invention relates generally to the art of weapon holders, and more specifically to secure firearm safes or holders.

In recent years a great deal of emphasis has been placed upon preventing unauthorized and improper use of firearms. Quite often such efforts have been directed toward placing impediments to accessing firearms, such as locking firearms in holders, or safes. However, a problem with placing impediments on the use of firearms is that the impediments often hinder authorized users from having immediate access to their weapons. In this regard, a number of US patents describe handgun storage cases, gun locks, gun safes and the like for storing handguns, a few of these being: U.S. Pat. No. 5,056,342 to Prinz; U.S. Pat. No. 5,118,175 to Costello; U.S. Pat. No. 5,236,086 to MacTaggart; U.S. Pat. No. 5,683,021 to Satina; U.S. Pat. No. 5,881,584 to Brunoski et al.; U.S. Pat. No. 5,901,589 to Cordero; U.S. Pat. No. 5,987,941 to Zocco; U.S. Pat. 6,405,861 to Siler et al.; and U.S. Pat. No. D426,059 to Siler et al.

The devices described in these patents have a number of disadvantages; however, a common disadvantage of all of them is that they do not provide sufficiently quick and ready access to firearms for authorized users.

Thus, it is an object of this invention to provide a secure firearm holder that provides ready and immediate access of firearms to authorized users but yet that maintains the firearms secure against use by unauthorized users.

It is yet another object of this invention to provide such a firearm holder that is relatively uncomplicated and inexpensive to both manufacture and use.

SUMMARY OF THE INVENTION

According to principles of this invention, a secure firearm holder includes an outwardly swinging hinged plate that is hinged to a holder base, with a firearm mounted on the plate in a ready-to-use orientation when the plate swings outwardly.

For example, according one mode of operation of a preferred embodiment, the secure firearm holder is oriented so that the hinged plate swings upwardly with a top edge of the gun being immediately adjacent a bottom side of the hinged plate and a bottom edge of the gun directed, downwardly, away from the plate.

According to a preferred embodiment, a bore shaft is mounted on the hinged plate, with the bore shaft extending into the firearm. Thus, the firearm is mounted on the plate by the bore shaft. When the plate is in a first, closed, position, the holder base prevents the gun from being removed from the bore shaft, but when a motivating member rotates the plate about the hinge to a second position, the gun can be easily and quickly removed from the bore shaft in the ready-to-use orientation.

The holder base can be a box and the plate can be a lid of the box, with the lid's first position being closed on the box. In this case, the bore shaft extends parallel to the lid, but spaced therefrom, with a free end of the bore shaft extending away from a hinge attaching the lid to the box. The motivating member biases the lid toward the second position but the lid is held closed in the first position by a latch, which latch is remotely releasable. A locking mechanism has three positions: a totally-locked position for locking the latch against remote release of the lid; an active position for allowing remote release of the lid; and a manual-release position for releasing the lid manually. A remote actuator is included for unlocking the latch when the locking mechanism is in the active position.

BRIEF DESCRIPTION OF THE DRAWINGS

The invention is explained and described in more detail below using embodiments shown in the drawings. The described and drawn features, in other embodiments of the invention, can be used individually or in preferred combinations. The foregoing and other objects, features, and advantages of the invention will be apparent from the following more particular description of the preferred embodiments of the invention, as illustrated in the accompanying drawings, in which reference characters refer to the same parts throughout the different views. The drawings are not necessarily to scale, emphasis instead being placed on illustrating principles of the invention in a clear manner.

DESCRIPTION OF THE PREFERRED EMBODIMENT

Figure 1:
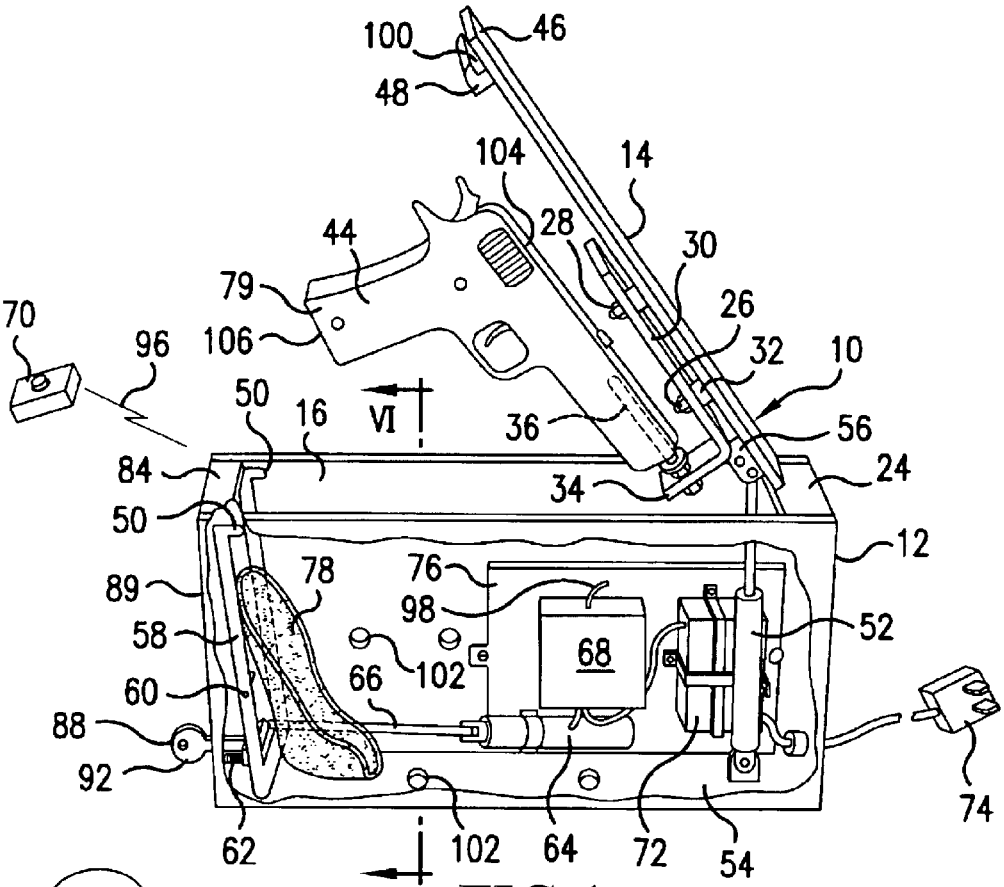
FIG. 1 is a cutaway perspective view of one embodiment of a firearm holder of this invention, including a remote control, with a handgun mounted on the firearm holder, but with some of the elements being omitted for purposes of illustration.

A firearm holder 10 includes a holder base 12 with associated structure and a plate 14 that is hingedly attached to the holder base 12. In the embodiment of the invention depicted in the drawings, the holder base 12 is a box 12 and the plate 14 is a lid 14 for covering an opening 16 in the box 12. The plate, or lid, 14 has a semicircular hinge member 18 (shown in FIG. 2 but omitted in FIG. 1 for purposes of illustration) that is rigidly attached to an underside of the lid 14 at a first end portion 20 of the lid, and is pivotally attached at 22 to an underside of a first top member 24 of the box 12. Thus, the lid 14 can hinge on the box 12 between a first, closed, position, as depicted in FIG. 2, and a second, open, position as depicted in FIG. 1.

The plate, or lid, 14 has threaded studs 26 welded to the underside thereof on which nuts 28 hold an L-shaped bracket 30 to the lid 14, but spaced therefrom by spacers 32. An attached leg 33 of the bracket 30 has attachment slots (or it could be one slot) extending longitudinally therealong, through which the threaded studs 26 extend so that the nuts 28 can be loosened and the position of the bracket 30 can be adjusted longitudinally along the plate 14. Of course, the nuts are again tightened once the bracket 30 is at a proper location. FIG. 1A depicts an alternate embodiment for mounting and adjusting a similar, but slightly modified, L-shaped bracket 30*a* with only one threaded stud 26 and nut 28, which employs a stabilizing bracket 31. In any event, a free-end leg 34 of the bracket 30 extends substantially perpendicularly away from the lid 14 and has a bore shaft 36 mounted thereon by nuts 38. In this regard, the bore shaft 36 is formed of a core threaded metallic shaft, with uncovered threads at the right end thereof (as depicted in FIG. 2) having the mounting nuts 38 screwed thereon. However, to the left of the nuts 38, the threaded shaft is covered with Teflon 40 and has a resilient spacer 42 immediately to the left of the left mounting nut 38. As can be seen in FIG. 1, a firearm, such as a handgun 44, can be mounted on the bore shaft 36 by extending the bore shaft 36 into the firearm's bore. The Teflon protects the bore. A second end portion 46 of the lid 14 has a catch. 48 mounted on an underside thereof for receiving latches 50 of a latching mechanism of the box 12.

Figure 1A:
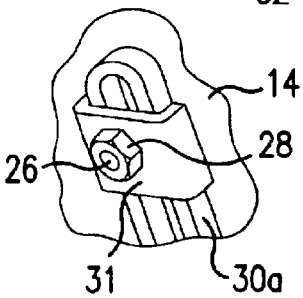
FIG. 1A is a segmented isometric view of a modified, one-nut, mounting of an L-shaped bracket of FIG. 1.
Figure 2:
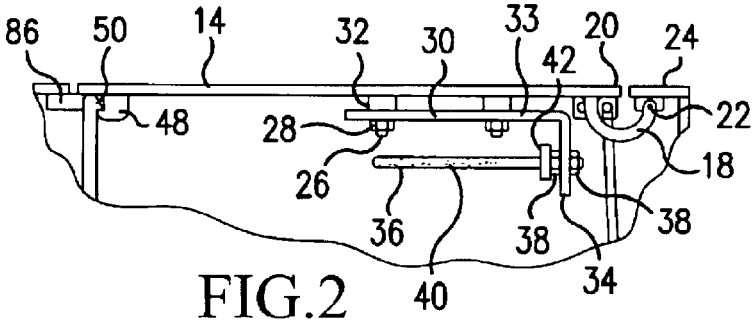
FIG. 2 is a fragmented, cutaway, side view of a lid of the firearm holder of FIG. 1 mounted on a box by a hinge.
Figure 3:
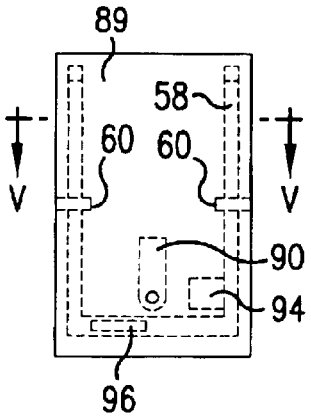
FIG. 3 is an end view of the firearm holder of FIG. 1 showing operation of a locking mechanism thereof.

Before describing the latching mechanism of the box 12, it is noted that the lid 14 is biased to the second, open, position, depicted in FIG. 1, by an expanding gas shock 52 that is mounted between a floor 54 of the box 12 and a bracket 56 mounted on the underside of the lid 14. In this regard, the bracket 56 has a series of apertures therein to which the gas shock can be attached, with an attachment aperture being chosen for providing a correct mechanical advantage and position for achieving a desired bias toward the second, open, position depicted in FIG. 1.

Turning now to the latching mechanism of the box 12, this includes a U-shaped rocker 58 having the latches 50 at outer tips of its arms and being rotatably attached to the box 12 by pins 60 welded respectively to each of two opposite inside side surfaces of the box 12. A bias spring 62 is connected between the rocker 58 and the box 12 for biasing the rocker 58 to rotate to a latching position as shown in FIG. 2. A solenoid 64 is coupled to the rocker 58 by an unlocking linkage 66, and this solenoid 64 can be energized by a battery pack 72 in response to a receiver 68 receiving a signal from a hand remote 70. The battery pack 72 includes a charger so that the battery pack 72 can be charged via a plug-in transformer 74. In the depicted embodiment, the receiver 68 and the battery pack with charger 72 are mounted as a unit on a plate 76 that is attached to the inside surface of the box 12 by threaded pins welded to the box and nuts that engage the pins. In this manner, the receiver 68 and the battery pack 72 can be easily removed from and mounted in the box 12 so that the receiver/battery pack unit can be assembled and mounted as a separate unitary packet. In one embodiment, the solenoid 64 is attached to the bottom of the box 12, but in the depicted embodiment it is also mounted on the plate 76 to become part of that unit.

Figure 6:
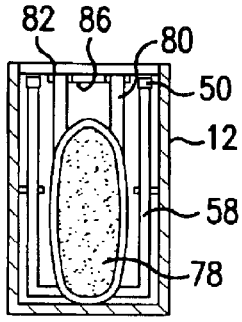
FIG. 6 is a simplified cross-sectional view taken on line VI—VI in FIG. 1.

A padded cradle 78 is mounted in the box 12 for receiving a handle 79 of the handgun 44. The padded cradle 78, as seen in FIG. 6, is held in position by slats 80 that engage slots 82 at an underside surface of a second top member 84 (see FIG. 6). A stop 86 welded to the underside of the second top member 84 helps to form these slots 82 and also serves to prevent the lid 14 from falling into the opening 16 when it is in the first, closed, position. That is, when the lid 14 is in the first, closed, position, it lies against the stop 86.

Figure 4:
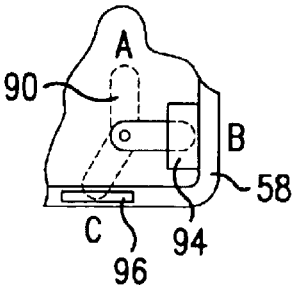
FIG. 4 is a fragmented, cutaway, detail of the locking mechanism of FIG. 3 depicting different locking positions thereof.
Figure 5:
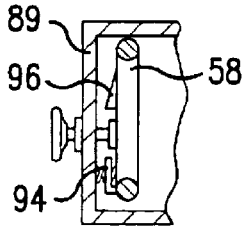
FIG. 5 is a top fragmented cross-sectional view taken on line V—V in FIG. 3.

Describing now a lock mechanism 88, a locking latch 90 thereof can be rotated on an end wall 89 of the box 12 by a removable key 92 to three different positions as shown in FIG. 4. In a first, active, position A, the locking latch 90 does not impinge on anything; thus, it allows the bias spring 62 to move the rocker 58 to a position for engaging the latches 50 with the lid catch 48. However, in this, active, position A, the solenoid 64 can overcome the bias spring 62 upon activation of the remote 70 to unlock the lid 14 and allow the expanding gas shock 52 to open the lid 14.

Should the locking latch 90 be rotated by the removable key 92 to a totally-locked position B, it engages a catch flange 94 affixed to the rocker 58 and will therefore not allow the rocker 58 to be moved to a lid releasing position by the solenoid 64. Thus, when the locking latch is in the totally locked position B, the lid 14 cannot be opened.

On the other hand, when the locking latch 90 is moved to the manually-unlocking position C, it impinges on an inclined cam 96 affixed on a lower end of the rocker 58 and thereby manually causes the rocker 58 to pivot against the pull of the bias spring 62 until the rocker latches 50 release the lid catch 48. Thus, by rotating the removable key 92 to cause the locking latch 90 to move to the position C, one can manually open the lid 14.

Describing now operation of the firearm holder 10, its normal mode of operation is carried out when the locking latch 90 is in the, active position A where it impinges nothing. This allows remote operation of the firearm holder. In this regard, in order to place the handgun 44 into the firearm holder 10, an authorized person manipulates the hand remote 70 to cause a signal 96 that is picked up by an antenna 98 of the receiver 68. The receiver 68, in turn, energizes the solenoid 64 from the battery pack 72 to pull the bottom end of the rocker 58 toward the solenoid 64 by overcoming the bias spring 62. This, of course, pivots the rocker 58 so that the rocker latches 50 release the lid catch 48 and the expanding gas shock 52 automatically rotates the lid 14 about the pivotal attachment 22 of the semicircular hinge member 18. Thus, the lid 14 moves to the position shown in FIG. 1. The handgun 44 is then telescoped onto the bore shaft 36, with the bore shaft 36 extending into the bore of the handgun 44. The lid 14 is then manually rotated downwardly until the top surface of the rocker latches 50 engage the lid catch 48 to thereby rotate the rocker in a counter clock-wise direction (as seen in FIG. 1) through cam action of the latches 50 with the catch 48. Once the latches 50 can enter a catch cavity 100 of the catch 48 they do so automatically under force of the bias spring 62.

The normal manner of thereafter gaining access to the handgun is to manipulate the hand remote 70, causing the signal 96 which is picked up by the receiver 68 that in turn energizes the solenoid 64 to rotate the rocker 58 and release the latches 50. Again, the expanding gas shock 52 rotates the lid 14 to the open position shown in FIG. 1 and the handle of the handgun 44 is totally free and oriented to be gripped by a user who easily pulls the handgun from the bore shaft 36.

Should the authorized user desire that the firearm holder 10 not be accessible with the hand remote 70, he rotates the lock mechanism 88 to the totally-locked position B, which prevents the rocker 58 from being rotated by the solenoid 64.

Finally, should the authorized user desire to open the firearm holder manually, such as when the battery pack 72 is dead or the hand remote 70 is lost, he rotates the lock mechanism 88 to the manually-unlocking position C.

It is noted that since, under normal use, the lid 14 is automatically operated by the remote 70, the user can open the lid 14 before he arrives at the firearm holder 10 and the handgun 44 will already be available for him to grip when he arrives. When the lid 14 is in the first, or closed, position, the handle of the handgun is held snuggly in the padded cradle 78 so that it is fully stabilized within the box 12, should the box be rotated or turned upside down.

In this respect, the box 12 is provided with a number of mounting holes 102 both in its bottoms and on its sides. In this regard, in addition to the box being mounted with the lid 14 opening upwardly as shown in FIG. 1, it can also be mounted on its side, below a counter or other surface. When the box 12 is mounted on its side, and the lid 14 moves to the second, open, position, the handgun 44 is automatically rotated by gravity to a vertical position on the bore shaft 36, again, so that it can be easily gripped by a user.

The embodiment depicted in the drawings, in which the holder base 12 is vertical and the plate 14 opens upwardly with an upper edge 104 of the gun 44 being immediately adjacent the plate 14 and a lower edge 106 of the gun directed away from the plate 14 has distinct advantages. In this mode, the handgun is clearly visible and both sides of the gun are free to be gripped.

Although the firearm holder 12 has its own power source in the form of the battery pack to make it portable, it is normally left plugged in to keep the battery charged. The firearm holder of this invention can be used in a home, on vehicles, on water vessels as well as in other places.

It is beneficial that the firearm holder of this invention can be opened before a user arrives at the firearm holder. But it is also beneficial that, when necessary, it can be totally locked so that the remote 70 cannot open it, for safety reasons.

In the drawings, the firearm holder is shown used with a 44 pistol. However, it could be made in various shapes and sizes to be used with various other firearms, including rifles. In the depicted model, the firearm holder has a length of approximately 14–½ inches, a height of approximate 8 inches and a width of approximately 4 inches. The firearm holder of this invention is so safe that it can be used to store a loaded gun. Further, the box has enough room in it for holding additional magazines. Of course, the dimensions can be changed to fit firearms with which the firearm holder is to be used.

It is beneficial that the firearm holder of this invention presents a gun to a user in a safe manner oriented and positioned exactly where the user can easily grip it, but facing away from the user for added safety.

While the invention has been particularly shown and described with reference to preferred embodiments, it will be understood by those skilled in the art that various changes in form and detail may be made therein without departing from the spirit and the scope of the invention.

For example, there could be a light in the box 12 that automatically turns on when the lid 14 opens.

Also, it is desirable that the box be bolted down so that it cannot be carried away with a firearm inside. In this respect, the bolts are installed from inside the box 12 through the mounting holes 102 so when the lid 14 is latched closed the bolts cannot be accessed.

Similarly, it is noted that the semicircular hinge member 18 is particularly designed to be totally inside the box 12 so that an unauthorized person cannot remove the lid by tampering with the hinge.

Along the same lines, it would be possible to place a motion sensor in or on the box, which would sound an alarm if an unauthorized person tries to move the box.

The firearm holder of this invention can be adapted to fit almost any firearm, including a rifle, and it can be in the form of a stand, rather than a box.

When a box is used, it is desirable that the box be fabricated to an appropriate degree of strength. Heavy steel construction is preferable, such as 3⁄16" steel for the box and ¼" steel for the lid. The lid could also be 3⁄16". Stainless steel can be used for many parts.

The remote 70 could be on a user's watchband, key chain, necklace, clothing, etc.

The box can be dimensioned for allowing a gun with an attached flashlight on the muzzle to be mounted therein.

A resinous plastic other than Teflon can cover the bore shaft.

Figure 7:
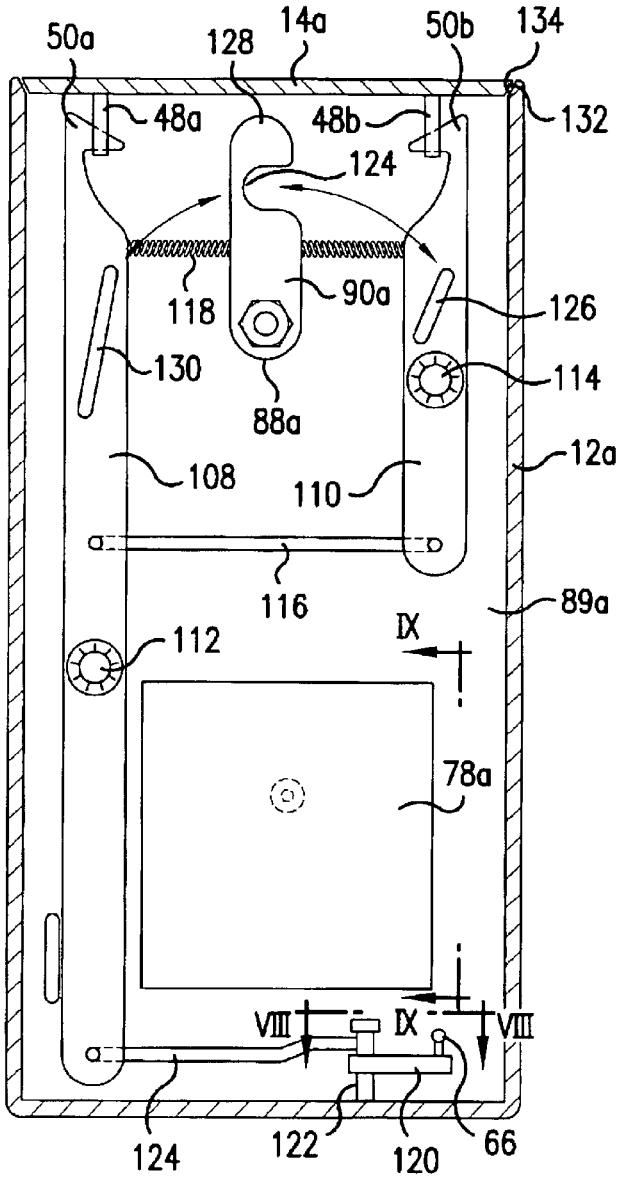
FIG. 7 is a view similar to FIG. 6, but with alternate-embodiments of a number of elements of this invention.
Figure 8:
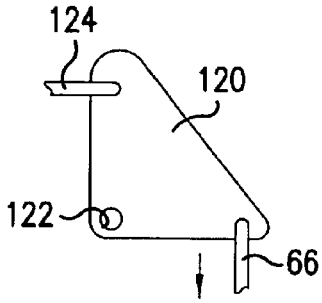
FIG. 8 is a segmented cross-sectional view taken on line VII—VIII in FIG. 7.
Figure 9:
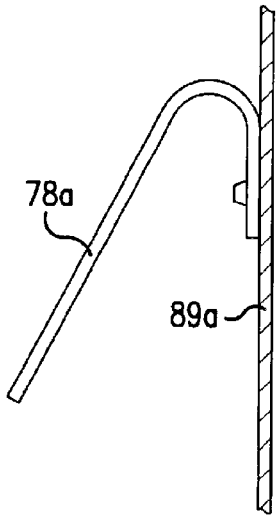
FIG. 9 is a segmented cross-sectional view taken on line IX—IX in FIG. 7.

FIGS. 7–9 depict an alternate embodiment of the invention in which lid catches 48*a* of a lid 14*a* are engaged by latches 50*a* and 50*b* of a long lever 108 and a short lever 110. The long and short levers 108 and 110 respectively rotate about pivot pins 112 and 114 affixed to the end wall 89*a* of the box 12*a* and are interconnected by a lever link 116. The long and short levers 108 and 110 are biased to the latching position depicted in FIG. 7 by a tensioned spring 118 in which they hold the lid 14*a* in the closed position. However, the latches 50*a* and *b* of the long and short levers 108 and 110 can be caused to move away from one another, and thereby to release the lid catches 48*a* and *b*, by a solenoid (the solenoid 64 of FIG. 1, for example) pulling on the unlocking linkage 66 to rotate a right-angle lever 120 about a pivot pin 122 and thereby rotate the long lever 108 via a link 124 in a counter-clockwise direction. The long lever 108, in turn, rotates the short lever 110 in a clockwise direction via the lever link 116 so that the latches 50*a* and *b* release the lid catches 48*a* and *b*.

A lock mechanism 88*a* is shown in the active position in which a locking latch 90*a* does not engage either of the long and short levers 108 and 110 so that they can be activated by a remote as described above. The lock mechanism can be moved to a totally-locked position by rotating the locking latch with a removable key (such as key 88) so that its notch 124 engages a protrusion 126 on the short lever 110 to thereby hold the long and short levers 108 and 110 in the latching position so that the remote cannot be used to open the lid 14*a*. Finally, the lock mechanism can be moved to a manually unlocking position in which a nose 128 of the locking latch 90*a* impinges on a protrusion 130 on the long lever 108 to manually force the latches 50*a* and *b* apart. Thus, the lid 14*a* can be unlatched manually with the removable key should the battery become shorted, for example.

In the embodiment of FIGS. 7–9, the padded cradle 78 of the FIGS. 1–6 embodiment is replaced by a spring-metal, gun-butt tensioner 78*a* that is attached to the end wall 89*a*. The gun-butt tensioner 78*a* applies pressure on a handle of a handgun mounted as shown in FIG. 1 to ensure that the gun stays on the bore shaft 36 and does not prevent the lid 14*a* from opening. It is significant that the tensioner 78*a* is an upwardly angled leaf spring because with this structure it encourages the gun to move upwardly with the lid 14*a*.

The embodiment of FIGS. 7–9 has an additional feature that prevents sticking of the lid 14*a* when it is opened by the expanding gas shock 52. Namely, outer edges 132 of the lid 14*a* are beveled as are mating surfaces 134 of the box 12*a*. Such beveling eliminates friction between the lid 14*a* and the box 12*a*, and thereby prevents the lid from sticking.

Otherwise, the embodiment of FIGS. 7–9 function in the same manner as described above for the FIGS. 1–6 embodiment.

While the invention has been particularly shown and described with reference to preferred embodiments, it will be understood by those skilled in the art that various changes in form and detail may be made therein without departing from the spirit and scope of the invention.

I claim:

1. A firearm holder comprising:

a holder base;

a plate attached to said holder base by a hinge attached at a first edge portion of said plate;

a motivating member connected between said holder base and said plate for rotating said plate at said hinge from a first position at which a gun held by said firearm holder is secure to a second position at which said gun can be removed from said firearm holder;

a bore shaft mounted directly on said plate for extending into a gun bore of said gun held by said firearm holder to thereby mount said gun on said plate by said bore shaft;

wherein, when said plate is in said first position the holder base prevents said gun from being removed from said bore shaft but when said motivated member rotates said plate about said hinge to said second position, said gun can be removed from said bore shaft.

2. A firearm holder as in claim 1, wherein said holder base is a box, and said plate is a lid of said box, said lid being closed in said first position with said gun on said bore shaft being positioned in said box and said gun coming out of said box as said lid moves to said open, second, position.

3. A firearm holder as in claim 2, wherein said bore shaft is mounted to said lid to extend parallel to the lid, but to be spaced therefrom.

4. A firearm holder as in claim 3, wherein a free end of said bore shaft extends away from said hinge, whereby when said lid moves to said second position said gun handle is automatically moved to a vertical orientation to be easily gripped, with an outer end of a barrel of the gun facing away from the user.

5. A firearm holder as in claim 4, wherein said motivating member maintains a constant bias for biasing the lid toward the second position and wherein is also further included a latch for latching said lid closed when said lid is manually moved to said first position.

6. A firearm holder as in claim 5, wherein said latch is part of a latch mechanism that includes a means for remotely releasing said latch and allowing said motivating member to rotate the lid to the second position.

7. A firearm holder as in claim 6, wherein is further included a locking mechanism for locking said latch against remotely releasing said lid.

8. A firearm holder as in claim 7, wherein said locking mechanism includes structure for manually causing the latch to release.

9. A firearm holder as in claim 6, wherein is further included in the latch mechanism a solenoid for remotely releasing the latch.

10. A firearm holder as in claim 9, wherein a rechargeable battery energizes said solenoid.

11. A firearm holder as in claim 2, wherein is further included a resilient cradle within said box for preventing undue movement of said gun in said box when said lid is in said first position.

12. A firearm holder as in claim 11, wherein said resilient cradle is an angled leaf spring that engages said gun and applies pressure on said gun when said lid is in said first position.

13. A firearm holder as in claim 1, wherein said bore shaft is a metal shaft covered by a resinous plastic.

14. A firearm holder as in claim 1, wherein said bore shaft is mounted to said plate to extend parallel to the plate, but to be spaced therefrom.

15. A firearm holder as in claim 1, wherein said motivating member maintains a constant bias for biasing the plate toward the second position and wherein is also further included a latch for latching said plate closed when said plate is manually moved to said first position.

16. A firearm holder as in claim 15, wherein said latch is part of a latch mechanism that includes a means for remotely releasing said latch and allowing said motivating member to rotate the plate to the second position.

17. A firearm holder as in claim 16, wherein is further included a locking mechanism for locking said latch against remotely releasing said plate.

18. A firearm holder as in claim 17, wherein said locking mechanism includes structure for manually causing the latch to release.

19. A firearm holder as in claim 15, wherein said latch is part of a latch mechanism that includes a means for remotely releasing said latch and allowing said motivating member to rotate the plate to the second position and wherein is further included a solenoid for remotely releasing the latch.

20. A firearm holder as in claim 19, wherein a rechargeable battery energizes said, solenoid.

21. A firearm holder as in claim 1, wherein is further included a resilient cradle within said box for preventing undue movement of said gun in said box when said plate is in said first position.

22. A firearm holder as in claim 21, wherein said resilient cradle is an angled leaf spring that engages said gun and applies pressure on said gun when said plate is in said second position.

23. A firearm holder as in claim 1, wherein said plate interfaces said holder base with angled edges to prevent sticking between said plate and holder base.

24. A secure firearm holder comprising:

a holder base;

a plate attached to said holder base by a hinge attached at a first edge portion of said plate;

a motivating member connected between said holder base and said plate for rotating said plate upwardly at said hinge from a first position at which a gun held by said firearm holder is secure to a second position at which said gun can be removed from said firearm holder;

a gun mounting means directly mounted on said plate for mounting said gun on said plate with a top edge of said gun adjacent said plate and a bottom edge of said gun extending downwardly away from said plate when said plate is in both said first and second positions;

wherein, when said plate is in said first position the holder base prevents said gun from being removed from said gun mounting means but when said motivated member rotates said plate about said hinge to said second position, said gun can be removed from said gun mounting means.

25. A firearm holder as in claim 1, wherein said hinge is positioned so that said plate rotates upwardly from said first position to said second position.

* * * * *